United States Patent [19]

Logullo

[11] 4,238,440

[45] Dec. 9, 1980

[54] PROCESS FOR SPINNING ACRYLIC FIBERS

[75] Inventor: Francis M. Logullo, Hockessin, Del.

[73] Assignee: E. I. Du Pont de Nemours and Company, Wilmington, Del.

[21] Appl. No.: 380

[22] Filed: Dec. 29, 1978

[51] Int. Cl.[3] ..... D01D 5/08

[52] U.S. Cl. ..... 264/176 F; 264/182; 264/206; 264/211; 525/336; 525/350

[58] Field of Search ..... 264/206, 176 F, 211, 264/182; 260/29.6 AN; 526/214; 525/336, 350

[56] References Cited

U.S. PATENT DOCUMENTS

| | | | |
|---|---|---|---|
| 2,434,054 | 1/1948 | Roedel | 526/214 |
| 3,380,949 | 4/1968 | Isley et al. | 260/30.4 |
| 3,448,092 | 6/1969 | Chiang | 260/79.3 |
| 3,819,762 | 6/1974 | Howe | 260/876 R |
| 3,828,013 | 8/1974 | Nield | 260/85.5 R |
| 3,879,360 | 4/1975 | Patron et al. | 526/224 |
| 3,896,204 | 7/1975 | Goodman et al. | 264/206 |
| 4,004,072 | 1/1977 | Tamura | 526/214 |
| 4,028,302 | 6/1977 | Tynan | 260/32.6 N |

OTHER PUBLICATIONS

Kirby et al., "Macromolecules", 1, pp. 53–58, (1968).

*Primary Examiner*—Jay H. Woo

[57] ABSTRACT

Acrylonitrile polymers containing at least 91% by weight acrylonitrile are spun from solutions having a polymer concentration of 38 to 75% by weight. Useful polymers have an intrinsic viscosity of 0.6 to 2.0, most preferably 0.9 to 1.1, 7 to 23 μeq./g. enolizable groups after mild acid treatment, 15 to 70 μeq./g. thioether ends derived from a water insoluble mercaptan and less than 3 μeq./g. oxidizable hydrolysis fragments.

7 Claims, No Drawings

PROCESS FOR SPINNING ACRYLIC FIBERS

BACKGROUND OF THE INVENTION

This invention relates to an improved process for spinning acrylic fibers from solutions of particularly high polymer concentration. The resulting fibers have improved initial whiteness as well as improved whiteness retention on heating.

Polymers for the preparation of acrylic fibers, which by definition contain 85% or more by weight acrylonitrile, are ordinarily prepared as an aqueous slurry using redox catalysts, e.g., potassium persulfate initiator and sodium bisulfite activator. In fiber form, these polymers have the disadvantage of being somewhat off-white in color as formed and discolor even further on heating at high temperatures. It is known that initial yellowness (lack of whiteness) and the tendency to discolor further on heating of the acrylic polymers is inversely related to the polymer molecular weight. Therefore, manufacturing practice has been to adjust polymer molecular weight to that required to provide fibers of acceptable whiteness. The use of higher molecular weight polymer than is needed to provide adequate fiber physical properties results in a loss of productivity since the solutions used in processing such polymers have higher viscosities than would otherwise be needed.

While the source of yellowness in acrylonitrile polymers and fibers prepared therefrom is not completely understood, it is now generally accepted that the color is due to a chromophoric structure consisting of a series of condensed naphthyridine rings each bearing a

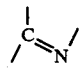

residue, several of which in an unbroken series absorb in the ultraviolet region of the spectrum, rendering the polymer yellow.

One method proposed for blocking formation of this chromophore is to prepare copolymers wherein the acrylonitrile units are separated by copolymeric units sufficiently often to prevent aggregation of the six or seven consecutive acrylonitrile units required for color formation. While effective, this method is generally not useful in the case of fibers because the amount of comonomer required, e.g., about 21% by weight in the case of methyl acrylate, is not conducive to good fiber properties, especially with respect to dimensional stability. Bulky comonomers are more effective on a weight percent basis in preventing formation of the chromophore but are equally disadvantageous with respect to dimensional stability. For example, as little as 10.5 weight percent styrene copolymerized with 89.5% by weight acrylonitrile results in significant shrinkage of fibers prepared therefrom under the hot-wet conditions encountered in commercial dyeing and laundering. Most commercial acrylic fibers contain no more than 9% by weight comonomer(s).

It has recently been proposed by Brandrup, Peebles et al., *Makromol. Chem.*, 98, 189 (1966) and *Macromolecules*, 1, 53–8 (1968) that the naphthyridine chromophores are formed from $\beta$-ketonitrile groups derived from an adduct formed by free radical attack on the nitrile groups in the polymer. U.S. Pat. No. 3,448,092 (Chiang) describes a polymerization process using coordination catalysts which provides acrylonitrile polymers having less than 5 $\mu$eg./g. $\beta$-ketonitrile groups. These polymers have improved stability to discoloration on heating. However, this process is disadvantageous because non-aqueous solvents must be used.

U.S. Pat. No. 3,828,013 (Nield) describes an emulsion polymerization process for preparing acrylonitrile polymers containing up to 95 mol percent acrylonitrile (90.6% acrylonitrile by weight when copolymerized with styrene) using a combination of low volatility and high volatility mercaptans as chain transfer agents to control molecular weight. Although primarily intended for the molding of bottles, the polymers are also said to be suitable for the preparation of fibers. Color stability of the polymers on heating is not mentioned.

Another emulsion polymerization process for the preparation of acrylonitrile polymers is described in U.S. Pat. No. 3,819,762 (Howe). Dodecyl mercaptan is used as a chain transfer agent in some of the examples but is not required by the claims. The resulting polymers containing up to 85% by weight acrylonitrile are suitable for molding into bottles. No suggestion is made that the polymers are suitable for the spinning of fibers.

The present invention provides an improved solution spinning process for the preparation of acrylic fibers having the process advantages of higher feasible polymer concentration, reduced sensitivity to discoloration resulting from process interruptions and reduced solution viscosity at the same polymer intrinsic viscosity.

This invention provides an improved process for spinning acrylonitrile polymer fibers from an acrylonitrile polymer containing at least 91% by weight acrylonitrile units and up to 9% by weight copolymeric units having an intrinsic viscosity of 0.6 to 2.0, 7 to 23 $\mu$eq./g. enolizable groups after mild acid treatment, 15 to 70 $\mu$eq./g. thioether ends derived from a water insoluble mercaptan and less than 3 $\mu$eq./g. oxidizable hydrolysis fragments wherein the polymer is dissolved in a solvent for the polymer to provide a solution having a polymer concentration of 38 to 75% by weight which is then spun by conventional spinning methods. Preferably the polymer concentration is 40–50% by weight and the intrinsic viscosity is 0.8 to 1.5. Most preferably the intrinsic viscosity is 0.9 to 1.1 and the solution is dry spun. Wet spinning is also preferred. Spinning may also be accomplished by plasticized melt spinning.

Polymer suitable for use in the present invention may be conveniently prepared as an aqueous emulsion using water, the desired monomers, relatively low concentrations of a free radical initiator, a surfactant and a water insoluble mercaptan as chain transfer agent. The resulting latex may be coagulated by any convenient means to facilitate isolation of the polymer.

The initiator may be a persulfate acid or salt such as potassium persulfate, an azo initiator such as azo-bis-(isobutyronitrile), azo-bis-($\alpha$,$\alpha$- dimethylvaleronitrile) or azo-bis($\alpha$,$\alpha$-dimethyl-$\gamma$-methoxyvaleronitrile) or a peroxide initiator such as t-butyl peroxyneodecanoate or other free radical initiator known in the art.

Low radical concentration is achieved by using a low initiator concentration and operating at low monomer(s)/$H_2O$ ratio and at temperatures as low as consistent with satisfactory conversion and yield. Usually polymerization in emulsion gives whiter, more stable polymer than polymerization in suspension probably because the polymer accumulates in the nonaqueous phase and thus is insulated from attack by radicals which are formed in the aqueous phase from the water soluble initiator (persulfate). The dodecyl mercaptan or other thiol chain transfer agent serves a dual function. It controls molecular weight by endcapping growing polymer radicals with hydrogen while initiating another chain with the residual RS.radical. Not only is the hydrogen capped end of the first chain stable but also the thioether end of the new chain is highly stable. Thus the second function is to supply a preponderance of stable ends.

The mercaptan chain transfer agent should be essentially insoluble in water. Aliphatic mercaptans having more than 7 carbon atoms are essentially insoluble in water. Dodecyl mercaptan is preferred. Use of an essentially water insoluble mercaptan made available in the polymerization zone by addition of a mutual solvent or an effective emulsifier tends not only to increase the resistance of the polymer to discoloration but also to compensate for the lower polymerization rate entailed by using a low initiator concentration.

Although dodecyl mercaptan is the preferred chain transfer agent, other oil soluble mercaptans including alkyl or aralkyl mercaptans varying in carbon atoms per molecule from 6 to 20 or more may be used. Other nonreactive groups such as hydroxyls, ethers and esters may be present so long as they do not increase water solubility and decrease oil solubility greatly. A final consideration is that the shorter chain mercaptans of $C_8$ or $C_6$ carbon content typically give lower polymer yields than do longer chain mercaptans.

Suitable surfactants should be nonsubstantive on the polymer, i.e., other than cationic if the polymer is designed to be dyeable with cationic dyes. Approximately 5% by weight or less of this surfactant, based on monomers, should efficiently disperse the monomers and chain transfer agent and provide an emulsion of the polymer that is coagulable yet stable to monomer stripping conditions and storage. Preferably, the surfactant should be removable by washing with water. Alkylphenol polyethyleneoxy sodium sulfates having up to 10 ethyleneoxy groups are preferred. The corresponding phosphates are also useful but are more difficult to remove because of lower solubility in hot water. In most instances, at least 0.5% by weight surfactant is required.

The amount of agitation required to produce the acrylic polymers useful in the present invention depends on the composition of the polymerization medium. If a preferred surfactant is present in sufficient quantities to provide a stable emulsion of the polymer, moderate agitation is sufficient. However, more vigorous agitation is required with use of lesser amounts of surfactant or with use of a less efficient surfactant. A deficiency in agitation can be compensated for in part by an increase in mercaptan content. Likewise, increased agitation tends to reduce the amount of mercaptan required to provide a given molecular weight polymer, other factors being constant.

The polymerization preferably is carried out in the range of 25°-65° C. Use of relatively high temperatures increases the rate of polymerization while reducing the molecular weight of the acrylic polymer. Use of relatively low temperatures has the opposite effect. Use of temperatures below about 25° C. results in polymerization rates too low to be commercially useful while temperatures above 65° C. encourage inefficient initiator decomposition and increase side reactions between the initiator and the mercaptan chain transfer agent.

Polymer may be recovered from emulsions by freezing or coagulation of the latex with salts or acids. Preferably, excess monomers first are stripped off under vacuum to prevent further polymerization and to facilitate coagulation. Salts such as sodium chloride, aluminum sulfate or magnesium sulfate and acids such as hydrochloric, sulfuric or phosphoric acids are useful coagulants. After the coagulant is added to the stripped latex, the mixture is heated until the coagulated particles grow large enough to filter easily.

Spinning solutions containing 40% by weight acrylonitrile polymer can be readily prepared using conventional mixing equipment. Solutions of higher concentrations, e.g., about 50% by weight acrylic polymer or higher are best prepared using twin screw extruders such as described in U.S. Pat. No. 4,028,302 (Tynan).

Spinning may be accomplished under conventional wet and dry spinning conditions. However, the improved stability of the polymer useful in the present invention allows use of much higher process temperatures without excessive discoloration of the resulting fibers. For example, use of cell wall temperatures as high as 280° C. in the dry spinning of acrylic fibers from N,N-dimethylformamide (DMF) solvent gave fibers of good color having a DMF content of only 0.7% as compared to 17% obtained when the usual cell wall temperatures of 140° C. are used.

By adding an optical brightener and a toner, acrylic fibers having whiteness similar to that of bleached cotton are obtained. Suitable brighteners are, for example, the coumarins taught in U.S. Pat. Nos. 2,945,033 and 2,878,138, the stilbenes taught in U.S. Pat. No. 2,838,504 and the p-substituted amidobenzoyl derivatives taught in U.S. Pat. No. 2,911,415.

Suitable toners are dyes, pigments or combinations of two or more dyes and/or pigments that are stable and retained under conditions of fiber manufacture and use. They should be suitably complementary in color to the yellowness of the fiber. Examples are Color Index Pigment Blue 10 or 15 and Color Index Pigment Violet 5.

The acrylic polymers useful in the present invention have lower solution viscosities at a given polymer concentration than comparable solutions of conventional slurry redox acrylic polymer. This is believed to be due to a lower degree of chain branching in the polymers useful in the present invention. The differences are especially noticeable at concentrations greater than 38% by weight.

TEST PROCEDURES

ENOLIZABLE GROUPS

β-ketonitrile groups are believed to be present in all free-radical-produced acrylonitrile polymers. They are formed during polymerization by attack of a radical on a nitrile group in a preformed or growing molecule, giving an enamine group. Subsequent hydrolysis leads to a β-ketonitrile group. The accepted reactions are outlined in both U.S. Pat. No. 3,448,092 and Macromolecules 1, 59 (1968). Such groups exist in two forms, keto and enol, that are in equilibrium with each other:

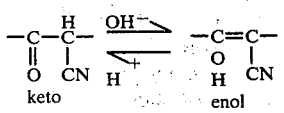

The procedure by which enolizable groups are measured in acrylonitrile polymers or fibers comprises mild acid treatment to insure conversion of all enamine groups to ketonitrile groups and titration by base, using a UV absorbance maximum found in the range of 270–275 nm as indicator. A faster method is based on UV absorbance alone, once a calibration of the absorbance difference has been done. The procedure is:

1. One gram of 50-mesh or finer polymer (or fiber) is stirred at the boil for one hour in 100 ml. water previously adjusted to 2.0 pH with hydrochloric acid. The mixture is cooled to room temperature and its pH is adjusted to 4 with dilute sodium bicarbonate. The polymer (or fiber) is removed by filtration, washed on the filter with 5 50-ml portions of water and vacuum dried at 50°–60° C. to constant weight.

2. About 0.16 g weighed to the nearest 0.1 mg. of the acidified and dried polymer (or fiber) is dissolved by stirring at room temperature in 40 ml. of a solution of one part propylene carbonate dissolved in three parts (by weight) of ethylene carbonate (EC/PC), the solvent previously having been stirred for about 30 hours with activated carbon and filtered. The solution is acidified to an apparent pH of 0 by addition of about 10 μeq. perchloric acid (0.1 N in methanol). The solution is divided into two 20 ml. portions.

3. One portion of the solution is used to fill a 1-cm cell, retaining the residue, absorbance is measured while scanning on a UV split-beam spectrophotometer from 350 to 250 nm to define exact location and intensity of absorbance at the maximum (in the vicinity of 270 nm). A 20-ml sample of solvent, to which the identical amount of perchloric acid has been added, is used to fill the reference cell, again retaining the residue.

4. To the second portion about 25 μeq. of potassium hydroxide (0.1 N) in ethanol is added to give an apparent pH of about 11; the same amount of base is added to the reference.

5. The absorbance scan is repeated. The difference in absorbance intensities at the maximum is directly related to the amount of enolizable groups in the polymer (or fiber) sample.

6. Calibration of the absorbance in terms of enolizable groups is done by making a series of absorption scans on a solution of about 1.0 g. polymer, weighed to the nearest 0.1 mg., in 50 cc EC/PC, first as described in steps 1–3 above, then (repetitively) after each of several additions of small known amounts of 0.05 N potassium hydroxide in ethanol until the final scan of the solution at an apparent pH of about 11. The absorbance intensities at maximum for the several scans are plotted, as a function of μeq. of base added after correction for dilution by the KOH solution. The straight-line portion of the plot provides the relationship between μeq. of base (and thus μeq. of enolizable groups) and absorbance difference.

Thioether Ends

Thioether end-group content is measured as the difference between strongly acidic, sulfur-containing groups and total combined sulfur. The steps involved are (1) removal of any monomeric, sulfur-containing contaminants, such as occluded dodecylmercaptan and any addition product of the mercaptan and a monomer, (2) dyeing with crystal violet and measuring the equivalents of dye taken up and (3) determination of the total sulfur. The procedure is: 1. 5 g polymer is dissolved in 100 ml DMF by cooling the DMF to 0°–5° C., dispersing the polymer therein and heating with agitation to about 50° C.

2. The solution is poured slowly into the vortex of 450 ml water being rapidly stirred in a blender. About 25 g sodium chloride is added to coagulate (precipitate) any soluble fraction, and stirring is continued for three minutes.

3. The suspension is poured into a beaker and heated to 70° C. It is cooled to about room temperature, filtered and washed on the filter with deionized water until the filtrate is found to develop no silver chloride precipitate on addition of silver nitrate.

4. The polymer is allowed to dry in air, then is ground in a mortar and stirred in 100 ml methanol at 55° C. for 30 minutes. The suspension is filtered; the residue is washed with methanol and vacuum-dried to constant weight.

5. The purified polymer is ground in a "Freezer Mill", using liquid nitrogen as coolant, to pass a 200-mesh screen.

6. About 0.25 g of the ground polymer (weighed to the nearest milligram) is transferred to a vial containing 2.5 mg. sodium acetate, 10 ml. 0.5% aqueous solution of crystal violet and 15 ml. water. The pH is adjusted to 4.5 with 1% acetic acid solution. The vial is capped, the cap secured with Teflon ® tape, and the vial heated for 3 hours in a boiling water bath with occasional shaking. The vial is cooled and 5 ml. 10% sodium chloride mixed with the contents.

7. The dyed polymer is filtered off using a Type-A, 1-micron glass filter pad, washed on the filter successively with 50/50 acetic acid/water, water and, finally, ethanol, in each case until the filtrate is colorless. The residue is dried for 20 min. in a vacuum oven at 60° C.

8. About 0.015 g of the dyed, washed and dried polymer is weighed to the nearest 0.0001 g. and transferred to a 100-ml volumetric flask. Dimethyl sulfoxide (DMSO) and 2 ml acetic acid are added, and nitrogen blown through until the polymer dissolved. The flask is filled to the mark with DMSO.

9. Absorbancies are measured at once at 690 nm (background) and at the crystal violet peak near 595 nm. The difference is net absorbance; from it μeq. strong-acid sulfur (dyesite) is calculated, using a calibration plot of net absorbancies vs. known concentrations of crystal violet, correcting for weight of the dye in the sample.

Total sulfur is determined by oxidation of a sample of the purified polymer under conditions that result in conversion of all sulfur to sulfate and titration with barium perchlorate; the steps are:

1. An amount of polymer (generally 250 mg. or less) calculated to contain 0.4–8 mg. sulfur is weighed to the nearest 0.001 g and burned in an oxygen flask to convert all sulfur to trioxide which is absorbed in a sodium carbonate solution previously added to the flask.

The sulfate solution is titrated with standardized barium perchlorate solution using the Thorin Alphazurine Blue end point. The barium solution is prepared by dissolving 0.05 moles barium perchlorate in 200 ml water and adding 800 ml ethanol. The solution is adjusted to an apparent pH within the range of 2.5–4 with dilute perchloric acid and standardized with standardized sulfuric acid, using the same indicator as to be used in the sulfate titration.

Oxidizable Hydrolysis Fragments

Oxidizable hydrolysis fragments are measured by alkaline hydrolysis of a polymer sample and titration with iodine. The procedure is: 1. About 2 g of polymer (or fiber), weighed to the nearest 0.0001 g, is stirred for three hours in 100 ml of 1.5% sodium hydroxide solution under reflux. During this treatment the suspension thickens and discolors, then thins and clears.

2. The resulting solution is cooled to room temperature and acidified to pH 2 with sulfuric acid, which results in a taffy-like precipitate. The mixture is again cooled to room temperature.

3. A starch indicator is added, and the mixture is titrated with 0.02 N iodine solution, using good agitation, until a blue color persists for one minute.

Intrinsic Viscosity is the limit of the natural logarithm of the ratio of the flow time of a dilute solution of a polymer to solvent flow time as the polymer concentration approaches zero. The solvent is a 0.2-molar solution of lithium bromide in dimethylformamide. The temperature at which the measurements are made is 25° C.

Hydrolytic Stability

Polymers of this invention are also characterized by a high resistance to hydrolysis by water at high temperature. This is important to processes such as taught in U.S. Pat. No. 3,984,601—shaping from a single-phase hydrate—and as disclosed in U.S. Pat. No. 3,774,387—shaping of plexifilaments from a dispersion of hydrate.

To measure hydrate stability, samples of finely ground polymer are sealed in glass tubes with ⅓ their weights of water and heated for varying periods of time at 180° C. On termination of its particular period of heating, each tube is cooled in dry ice, and immersed quickly in water; the suspension titrated to determine the amount of ammonia liberated. The onset of hydrolysis is taken as the time in hours at 180° C. for ammonia evolution to amount to 0.05 meq./g polymer.

It is important, of course, to assure the absence of alkaline materials in the polymer to be tested. This can be done by a preliminary treatment as in Step 1 of the above procedure for determining enolizable groups or by treatment with volatile acid such as a dilute solution of acetic acid, followed by thorough rinsing and drying.

Color

Yarn is evaluated for whiteness after winding on a metal card having a 7.6 cm hole in its center. The yarn is wound evenly on the card so as to cover the hole completely. Measurements are made on a Hunterlab Color and Color Difference Meter, Model D-25, using as a standard of comparison a Hunter standard white, MgO, plate.

L measures lightness and varies from 100 for perfect white to zero for black, approximately as the eye would evaluate it. The chromaticity dimension a measures redness when plus, gray when zero and greenness when minus. b measures yellowness when plus, gray when zero and blueness when minus.

Whiteness, or "W", values are provided by the D25W module when used with a Model D-25 Hunterlab Color and Color Difference meter. In this measurement, W=4.Blue-3.Green, emphasizing (reading as higher values) the blue reflectance, which correlates with the visual impression of whiteness and deemphasizing (reading as a decrease numerically) the yellowness reflectance. Details of the method for all tristimulus coordinates are given in the D-25 brochure published by Hunter Associates Laboratory, Inc., Fairfax, VA.

DMF Color Stability

In the process of dry spinning, the polymer is dissolved in a volatile organic solvent and extruded into an evaporative atmosphere. One of the preferred solvents is dimethyl formamide (DMF), which will accommodate a practical amount of polymer, but only at relatively high temperatures. Whiteness durability to extended periods of exposure to high temperature in DMF is an important characteristic of a polymer to be spun to fiber. In the test termed herein "DMFCS", a 2% solution of the polymer in DMF is heated under nitrogen for 3 hours at 130° C., cooled, and its absorbance at 425 nm measured. The values reported in the table are absorptivity, calculated as $$\left(\frac{\text{absorbance}}{C \cdot L}\right) \cdot 100,$$

in which absorbance is the difference between that measured on a sample which has not been heated and that measured after heating the solution 3 hours at 130° C., C is the concentration of polymer in the solution in grams/liter and L is the optical length of sample used to measure absorbance. The resultant is arbitrarily multiplied by 100 in order to obtain more convenient values for comparative purposes.

In the following examples, parts and percentages are by weight unless otherwise specified.

Polymer Preparation

I. Polymer According to the Invention

This illustrates some of the process variations that may be employed in the manufacture of acrylonitrile polymers for use in this invention.

The following Tables summarize 9 polymer runs. In the Tables, AN is acrylonitrile; MA is methyl acrylate; SSS is sodium styrenesulfonate; MMA is methyl methacrylate; AMPS is acrylamido-2-methyl propanesulfonic acid; SSA is styrenesulfonic acid; "Ultrawet 99LS" is a dodecylbenzenesulfonate surfactant sold by ARCO; "Gafac RE 610" is a nonylphenoxypoly(ethyleneoxy) phosphoric acid surfactant sold by G.A.F.: "Alkanol WXN" is a dodecylbenzenesulfonate surfactant sold by Du Pont; PVA is a polyvinyl alcohol; MeCel is methyl cellulose; and LM is lauryl mercaptan (n-dodecylmercaptan).

The process employed for Run I. as described below is generally the same as for those employed in Runs II, III, VI and VII. Variations in the preparation of these latter polymers are given in the Table.

This illustrates the preparation of a copolymer containing 92.2% by weight acrylonitrile, 7.3% by weight methyl acrylate and 0.5% by weight sodium styrene sulfonate.

Water (5976 kg.), sodium dodecylbenzene sulfonate ("Ultrawet" 99LS, 10.8 kg.) and sodium stryenesulfonate (5.26 kg.) are mixed at room temperature in a nitrogen blanketed (pressure=14-34 kPa), glass-lined 7570 liter kettle. The pH is adjusted to 7.1 with NaOH and the mixture heated to 50°-56° C. This is solution (1).

Acrylonitrile (964.8 kg.) and n-dodecylmercaptan (10.4 kg.) are mixed in a nitrogen blanketed kettle similar to that used above. This is solution (2).

Solutions (1) and (2) are blended at the inlet of a centrifugal transfer pump at the rate of 227 l./min. in a volume ratio of 6.3/1, respectively. A second centrifugal pump of smaller capacity than the first is piped backwards into the discharge of the first to provide additional turbulence. The resulting emulsion is fed into a jacketed polymerization reactor of 7570 liters capacity with agitation under a nitrogen blanket of 14 kPa while methyl acrylate (76.2 kg.) is added and the temperature raised to 59.5° C. over a 30 minute period.

The polymerization is initiated by adding an aqueous solution containing 820 g potassium persulfate. Polymerization is continued for five hours at 60°±1° C. The resulting latex is steam stripped at 55°-65° C. and 130-170 mm Hg. absolute to remove unreacted monomer. The latex is cooled to 30°-35° C. and continuously coagulated in two 284 liter vessels in series. Each vessel is equipped with a 20.32 cm, 2.54 cm. pitch propeller for agitation and is blanketed with nitrogen at 172 kPa. The propeller in the first vessel is operated at 1140 rpm and the propeller in the second at 300 rpm. The latex is pumped into the first vessel at 11.4 l/min along with an equal volume of water and 0.4 l/min 0.5% by weight aqueous $MgSO_4$ as coagulant. The coagulum flows from the first vessel to the second vessel where the polymer particles agglomerate to filterable size. The temperature of the first vessel is 70° C. and that of the second is 125° C.

The polymer is removed by filtration and washed and dewatered on a continuous belt filter 45.7 cm. wide and 4 m. long running at 6.4 m/min. Cake forming utilizes 51 cm. of belt length followed by two washing zones 61 cm in length and a steaming zone 76 cm in length. The final 1.5 m. of length is used for dewatering to a polymer content of 26%. 2380 Parts by weight water at 95° C. and 35.7 parts by weight steam are used per 100 parts by weight polymer.

The polymer is dried batch-wise to less than 2% by weight moisture in a rotating, double-cone vacuum dryer at first jacketed with 76°-88° C. water and then with 14-21 kPa steam in the later stages.

IV and VIII

Preparation of polymers IV and VIII is closely analogous. The description following is of the preparation of polymer IV. Variations in polymer VIII and its preparation are given in the Table.

This example illustrates continuous emulsion polymerization.

The apparatus used includes two reactors in series. The overflow from the first reactor flows into the second reactor. Both reactors are continuously fed reagents, as detailed below, and the polymer emulsion overflows continuously from the second reactor. Both reactors are equipped with 4 approximately 2-cm vertical indentations or ribs to damp swirling and enhance mixing and have jackets for water heating and cooling. Working capacities of the first and second reactors are 2.4 l and 12.8 l, respectively.

Feeds for the first reactor are emulsified in a first premixer which consists of a 500 cc 3-neck flask equipped with a stirrer having four blades 1 inch (2.54 cm) long and 0.25 inch (0.64 cm) wide operating at 2300 rpm. Feeds for the second reactor consist of the overflow from the first reactor and additional feeds, as detailed below, emulsified in a second premixer which consists of a 1000 cc, 3-neck flask equipped with a stirrer similar to that of the first premixer. The entire system is maintained under a nitrogen blanket.

The reactors are swept well with nitrogen, charged with the following ingredients just prior to start up and heated to about 65° C. by circulation of hot water in the jackets of the reactors.

| | Prefeed to Reactors | |
|---|---|---|
| | 1st Reactor | 2nd Reactor |
| Water | 1200 g | 6400 g |
| $K_2S_2O_8$ | 0.30 g | 2.23 g |
| Emulsifier- nonyl phenol poly (ethylene oxy) phosphate ("Gafac" RE610) | 12.05 g | 45.6 g |
| pH (adj. with $NH_4OH$) | 5.2 | 4.15 |

At startup, the following continuous feeds are begun to the inlets of the first and second premixers, respectively, which previously had been half filled with the same compositions less monomers and initiator:

| | Feed rates per minute | |
|---|---|---|
| | 1st Premixer | 2nd Premixer |
| Acrylonitrile (AN) | 15.64 g | 22.54 g |
| Methyl acrylate (MA) | 1.34 g | 2.01 g |
| dodecylmercaptan | 0.064 g(with AN) | 0.143 g(with AN) |
| sodium styrenesulfonate | 0.085 g (as 27 cc aqueous) | 0.133 g (as 10.9 cc) |
| Gafac RE 610 | 0.572 g | 0.186 g |
| $K_2S_2O_8$ | 0.02 g (as 5 cc aqueous) | 0.019 g (as (1.55 cc aqueous) |
| Water | 4.3 g | 6.36 g |

With these feed rates, holdup in reactor 1 is about 42 min. Holdup in reactor 2 is about 120 min. After start of the polymerization, reaction temperatures are maintained at 65°±0.5° C. by controlling the temperature of cooling water fed to the jackets.

Periodic samples of the emulsion that continuously overflows from the second reactor are coagulated at once, and the polymer removed by filtration washed, dried and weighed to determine conversion rate.

The overflowing emulsion from the second reactor is stripped to a monomer content of 120 ppm or less by first gently agitating while evacuating to a pressure of about 660 mm Hg, diluting with water to about 36% polymer content and countercurrent stripping in a packed column with steam.

Characterization data in Table II for these polymers (IV and VIII) were derived from plexifilaments produced from the polymer emulsion in the manner as generally described by U.S. Pat. No. 3,774,387, except that no clay or other surface active additive was employed in shaping.

V. Conventional Redox Polymer

The two items described under this heading in the Table were made in a commercial-scale, prior-art, redox, slurry polymerization process such as taught in U.S. Pat. No. 2,837,501, and are included as comparisons.

Semi-dull (0.4% $TiO_2$ delusterant) yarns made by art-known dry spinning process from polymers II, III, V-A, V-B and VI–VIII were knitted and the fabrics boiled for one hour in 0.1% NaOH solution to simulate the discoloration effect of severe commercial laundering. After thorough rinsing and drying, they exhibited yellowness corresponding to the "b" values in Table II. Enolizable groups content of the polymers are also included in Table II and a comparison between these values for the various polymers illustrates the correlation between them. Other characterization data in the table which in general correlate with enolizable group content are hydrolytic stability (HS) and DMF color stability (DMFCS); the latter is a measure of whiteness stability on exposure of a solution to high temperature.

It is apparent from the tabulated data that the polymers and the fibers made from them by the process of this invention are superior in whiteness not only initially but after use. The data in the "Simulated Severe Laundering" column illustrate the durability-of-whiteness advantage for several of the polymers useful in practice of the invention in comparison with two prior art polymers. Although such data are not available to illustrate adequacy of some of the tabulated polymers in this respect, it is the inventor's belief that all polymers within the scope of the characterizing limitations as described herein possess these advantages.

DMFCS, while of more practical concern in the manufacture of fiber of good initial whiteness, nonetheless reflects the advantage of improved whiteness durability of polymer during the high-temperature exposure involved in shaping.

EXAMPLE 1

The polymer of Run No. 1 (70 parts) and 30 parts of dry dimethylformamide were hand mixed and packed into a cylinder equipped with means for heating, a free piston with an O-ring seal, a spinneret with five holes 0.009 inch ×0.010 inch diameter×length (0.229×0.254 mm) and means to apply pressure behind the free piston. The spin proceeded smoothly with windup rate as high as 100 ypm (91 m/min) at a temperature of 150° C. under a pressure of 650–800 psig (4482–5516 kPa), although the filaments were somewhat rubbery, which limited drawability. More normal performance was obtained by first raising the temperature to 160° C. (which produced bubbly yarn) then dropping it to 152° C., which led to good quality yarn of normal drawability at a windup speed as high as 110 ypm (100 m/min). The yarn was surprisingly bright and free of the yellowness expectable in yarn produced from solutions with such high-temperature exposure.

The yarn was drawn to 200% (2X) and 300% (3X) of its as-spun length. The 3X-drawn yarn had tenacity/elongation/modulus values of 2.3 gpd/38%/54 gpd (203 mN/tex//38%//4768 mN/tex).

EXAMPLE 2

A. A 45% by weight solution of a polymer made by the process of Run No. I in N,N-dimethylformamide (DMF) is prepared by using a vibrating screw conveyor to meter finely ground polymer at 22 g/min to the feed zone of a Werner & Pfleiderer Model ZDS-K28 co-rotating twinscrew devolatilizing extruder. The diameter and length of the co-rotating screws are 28 and 773 mm, respectively. The screws are operated at 260 rpm. The extruder is assembled in six zones: a feed zone, two water-cooled zones, and three heated zones. The temperatures in the five zones beyond the feed zone are on average 23° C., 26° C., 106° C., 125° C. and 120° C. The polymer is fed into the feed zone and compacted there to form a seal. Toward the end of the first water-cooled zone, dry DMF and 3 parts per million based on polymer of a whitener comprising a mixture of 70 parts Monastral® Blue and 70 parts Platinum Violet are injected at 28.3 cc/min (26.9 g/min) to form in the second water cooled zone a cool slurry of polymer and solvent. Subsequent zones serve to dissolve, thoroughly mix and deaerate the solution which was collected in a pressurizable cylinder equipped with a free piston and a 34 hole spinneret. Pressure applied to the piston forced the solution through the spinneret (holes 0.127 mm in diameter) from which the filaments pass through a 5.5-m long, 15.2-cm internal diameter spinning cell which is electrically heated. A cocurrent stream of heated inert gas serves to remove the evaporated solvent in the upper ⅔ of the cell. The bottom ⅓ of the cell is provided with a countercurrent flow of inert gas for cooling of the filaments. The filaments are easily wound up at 125 ypm (114 m/min) and spinning at 210 ypm (192 m/min) was promising enough to suggest operability at that speed or higher with fine tuning of conditions.

B. The spin described under A. was attempted with substitution polymer from Run V-A. The only other change was the inclusion of 5X the amount of whitener in an effort to correct the greater tendency of this polymer to discolor at high temperature. Although the conditions that led to the promising 210 ypm (192 m/min) spin of part A. were used, no spinning was accomplished. The filaments lacked sufficient continuity to reach the wind up and broke in the spinning cell. The experiment was terminated after spending two hours in attempts to string up the filaments.

EXAMPLE 3

This example directly compares the whiteness of yarns shaped from the polymer of Example 2 with that of yarn shaped from the polymer of Run No. V-A.

A. The polymer of Example 2 (42.1 parts) is mixed with 57.9 parts dry dimethyl formamide twin-screw-extruder mixed as in that example at an overall feed rate of 70 g/min. The screw speed is 260 rpm, and the temperatures (zones 1–5) are on average 20°, 23°, 94°, 117° and 117° C., respectively. The metered solution is passed through a heated transfer line containing a 200μ filter and a viscometer to a spinning cell, the residence time in the transfer line being 20.3 minutes. Solution viscosity is 268 poises and the shear rate is 8.96 $sec^{-1}$. The solution is spun as in that example at speeds of 250–300 ypm (229–274 m/min). The resulting yarn has L/a/b/W values of 84/-0.6/4.5/49.

B. The polymer of Run No. V-A (40 parts) is mixed with 60 parts dry dimethyl formamide in the twin-screw extruder and processed as in part A. using a screw speed of 278 rpm and pumped through the transfer line at an overall rate of 58.9 cc/min. The extruder temperatures are 22, 24, 101, 120 and 120 in zones 1–5, respectively. Solution viscosity is 425 poises, and the shear rate is 7.0 $sec^{-1}$. The solution is spun at 300 ypm (274 m/min). The resulting yarn has L/a/b/W values of 88/-0.8/7.3/41.

TABLE 1

| Run No. | Emulsifier (% on Monomer) | Initiator (% on Monomer) | T/React. Time °C./hrs. | Chain Terminator (% on Monomer) | Conversion (%) | Polymerization Type |
|---|---|---|---|---|---|---|
| 1 | Ultrawet 99LS (1) | $K_2S_2O_8$ (0.08) | 60/5 | LM (1.01) | 75 | Batch |
| 11 | "Alkanol" WXN (3) | $K_2S_2O_8$ (0.15) | 60–70/3 | LM (0.86) | 65 | Batch |
| 111 | Gafac RE610 (4) | $K_2S_2O_8$ (0.1) | 67/0.5 | LM (0.7) | 30 | Continuous |
| 1V | Gafac RE610 (1.8) | $K_2S_2O_8$ (0.093) | 65°/2 | LM (0.5) | 83 | Continuous |
| V-A. V-B | None | $K_2S_2O_8$/ $NaHSO_3$ .31/2.5 | 60/62 min. | none | 80 | Continuous |
| V1 | Gafac RE610 (2.5) | $K_2S_2O_8$ (.031) | 60/5 | LM (0.94) | 80 | Batch |
| V11 | PVA (0.26) Methocel(0.38) | Vazo® 52 (0.25) | 60/3 | LM (1.26) | 78 | Batch |
| V111 | Gafac RE610 (3) | $K_2S_2O_8$ (0.2) | 65/1.5 | LM (0.7) | 86 | Continuous |

TABLE 11

| Run No. | Polymer Feed Comp. (%) | [η] | EG (μeq/g) | TE (μeq/g) | OHF (μeq/g) | HS (hrs.) | Fiber Whiteness (boiled off) (b/L/W) | DMFCS | Simulated Sever Laundering "b" |
|---|---|---|---|---|---|---|---|---|---|
| 1 | AN/MA/SSS (92.2/7.3/0.5) | 0.93 | 16 | 45 | 1.8 | 7 | 2.2/85/62 | .12 | |
| 11 | AN (100) | 1.5 | 9 | 50 | 1 | 9.2 | −0.2/87/77 | .07 | 3 |
| 111 | AN/MA/SSS (93.7/5.6/0.7) | 1.0 | 19 | 34 | 1 | 6.4 | 3.1/90/- | — | — |
| 1V | AN/MA/SSS 91.5/8.0/0.5 | 1.32 | 14 | 18 | 1.5 | 6.5 | 3.0/97/77 5/87/48 | | |
| V-A | AN/MA/SSS | 1.0 | 35 | none | 18 | 3.5– | 5.7/94/56 | .83 | 13.1 |
| V-B | 93.9/6/0.1 | 1.4 | 27 | none | 17 | 4.5 | 5.7/94/56 | .35 | 7.8 |
| V1 | AN/MA/SSS 91.3/8/0.7 | 0.96 | 14 | 44 | 1.5 | 7 | 1.6/94/50 | .13 | 1.9 |
| V11 | AN/MA/t-BuA-SSS (90.7/7.8/1.5) (91.3/7.9/0.8*) | 0.82 | 11 | 61 | 1 | 6.5 | 3.1/90/65 | — | — |
| V111 | AN/MA/SSS 91/8/1 | 1.1 | 17 | 30 | 1 | 8 | 2.3/95/78 | .14 | 1.8 |

*As sodium salt of SSA; made as the triamylamine salt; becomes the sodium salt on scouring.

I claim:

1. Process for spinning acrylonitrile polymer fibers of an acrylonitrile polymer containing at least 91% by weight acrylonitrile units and up to 9% by weight copolymeric units having an intrinsic viscosity of 0.6 to 2.0, 7 to 23 μeq./g. enolizable groups after mild acid treatment, 15 to 70 μeq./g. thioether ends derived from a water insoluble mercaptan and less than 3 μeq./g. oxidizable hydrolysis fragments wherein the polymer is dissolved in a solvent for the polymer to provide a solution having a polymer concentration of 38–75% by weight which is then spun by conventional dry, wet or plasticized melt spinning methods.

2. Process of claim 1 wherein the polymer concentration is 40–50% by weight.

3. Process of claim 1 wherein the intrinsic viscosity is 0.8 to 1.5.

4. Process of claim 1 wherein the intrinsic viscosity is 0.9 to 1.1.

5. Process of claim 1 wherein the solution is dry spun.

6. Process of claim 1 wherein the solution is wet spun.

7. Process of claim 1 wherein the solution is melt spun as a plasticized melt.

* * * * *